United States Patent [19]

Bozek

[11] Patent Number: 4,672,943

[45] Date of Patent: Jun. 16, 1987

[54] ARCHERY BOW WITH DRAW FORCE MULTIPLYING ATTACHMENTS

[76] Inventor: John W. Bozek, 6093 Waterfront Dr., Waterford, Mich. 48095

[21] Appl. No.: 846,484

[22] Filed: Mar. 31, 1986

Related U.S. Application Data

[63] Continuation of Ser. No. 619,552, Jun. 11, 1984, abandoned.

[51] Int. Cl.[4] ..... F41B 5/00

[52] U.S. Cl. ..... 124/23 R; 124/DIG. 1

[58] Field of Search ..... 124/23 R, 24 R, DIG. 1

[56] References Cited

U.S. PATENT DOCUMENTS

| | | | |
|---|---|---|---|
| 3,990,425 | 11/1976 | Ketchum | 124/23 R |
| 4,261,320 | 4/1981 | Barna | 124/24 R |
| 4,368,718 | 1/1983 | Simond et al. | 124/23 R |

*Primary Examiner*—Richard C. Pinkham
*Assistant Examiner*—Benjamin Layno
*Attorney, Agent, or Firm*—John R. Benefiel

[57] ABSTRACT

An archery bow is disclosed of the type having force multiplying rotary devices mounted to each tip of the limbs of the bow member, which act to reduce the required bowstring draw force at full draw. Each of the rotary devices are comprised of three rotary elements mounted for rotation about a common axis, a first element connected to the bowstring, and second and third elements connected to a pair of load cables so as to be in opposition to each other, and with one of the second or third elements able to exert a greater leverage about the common axis. This arrangement causes longitudinal bending of the limbs upon drawing of the bowstring, with the bending of the limbs equalized by the action of the load cables in being connected to each of the rotary devices. The load cables are routed along the handle section to be out of the way in the central region of the bowstring. The configuration of each of the rotary elements provides a variable leverage force to reduce the draw force as the bowstring reaches maximum draw.

6 Claims, 8 Drawing Figures

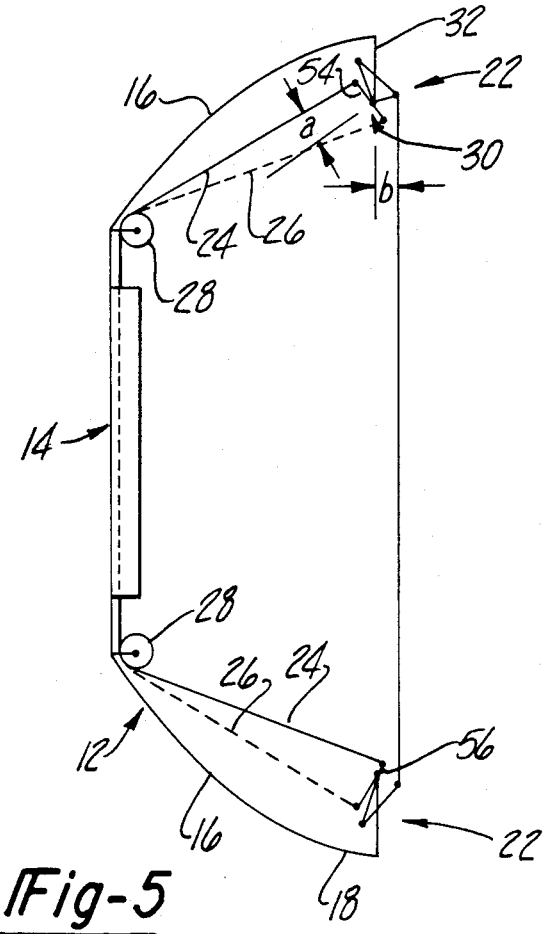
Fig-5
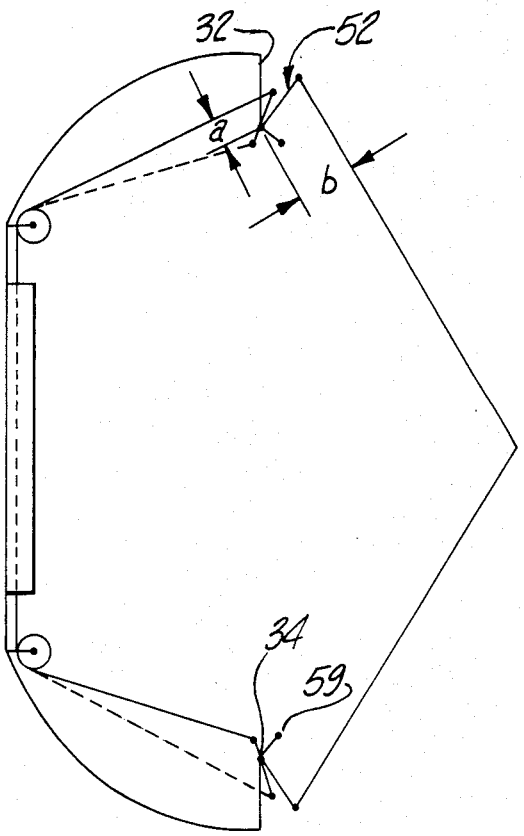
Fig-6
Fig-7
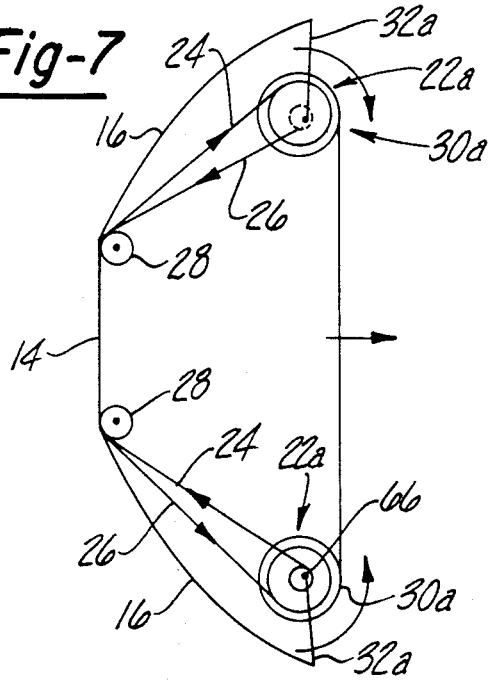
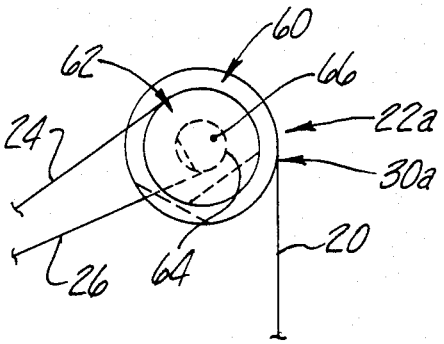
Fig-8

ARCHERY BOW WITH DRAW FORCE MULTIPLYING ATTACHMENTS

This application is a continuation of application Ser. No. 619,552, filed June 11, 1984, and abandoned on Mar. 31, 1986.

BACKGROUND DISCUSSION

This invention concerns archery bows and more particularly archery bows of the type having means for reducing the force required to maintain the bowstring in its full draw position, commonly referred to as a "compound bow".

An archery bow of the compound bow type is described in U.S. Pat. No. 3,486,495 to H. W. Allen. In this construction, a pair of eccentric rotary elements are mounted on either tip of the limbs of the bow member and the bowstring is wrapped around the exterior of each rotary element and connected thereto such that drawing of the bowstring rotates each rotary element about its axis of rotation. The rotary elements are also each connected to a load cable which extends from the connected rotary element alongside the bowstring to the opposite limb tip where it is anchored. The configuration of the rotary elements and the points of connection of the load cables and bowstring is such that as the elements rotate, a variable leverage is exerted by the load cables tending to bend the bow member limbs. This occurs in such a manner that the force required to maintain the bowstring in its fully drawn position is less than the maximum force required at some point during the drawing of the bowstring.

This has the distinct advantage of not requiring maximum force to be exerted by the archer to improve aim and release, and also improves the manner of launching of the arrow, since the forces applied to the arrow increase progressively with recovery motion of the bowstring.

These advantages have led to very widespread use of the principle of the Allen patent which has had a revolutionary impact on the art.

The presence of the load cables extending between the tips of the bow member, however, is a disadvantage in that it tends to interfere with the shooting of the bow since the load cables occupy the central region of the bowstring where the arrow is nocked. The presence of the load cables is also aesthetically unpleasing and particularly so when various fixtures are employed to hold the load cables out of the way as they pass through the space adjacent the arrow nocking point on the bowstring.

In U.S. Pat. No. 4,261,320 to Barna, there is disclosed a rerouting of the load cables through the handle section of the bow member by means of guide pulleys. The force exerted by the load cables is exerted in a direction generally aligned with the bow member limbs producing "longitudinal" flexing of the bow limbs, in addition to conventional transverse flexing of the bow limbs produced by the bowstring directly. Such longitudinal flexing is advantageous in that this mode of loading of the limbs stores more energy for a given degree of bending of the limbs and therefore requires less deflection to generate a given output force. This allows shorter limbs to be used.

Another benefit is a reduction in force with increasing flexing to contribute to the variable leverage effect of the rotary elements.

There is a significant negative side effect in routing load cables so as to produce longitudinal flexing of the limbs, i.e., a lack of equality or symmetry of the bending of the limbs. This may occur if the arrow is nocked offcenter on the bowstring. This uneven bending may adversely affect the accuracy of the shot.

This effect is not present to any significant degree in the construction of the Allen patent since the transverse deflection of the bow member limbs is cross leveraged by the load cables and the bowstring. That is, the reaction force tending to require to deflect transversely each limb tip is absorbed by the opposite limb tip, inherently equalizing the bending of tips with each other.

When the load cables are aligned with and anchored to the bow member limbs, no such cross leverage effect is present. Thus, a simple rerouting of the load cables as shown in the Barna patent would inherently produce this undesirable side effect.

In recognition of this, most constructions proposed have included a synchronizing mechanism as in the Hoffmeister patent, U.S. Pat. No. 3,854,467. The synchronizing device disclosed therein comprises an additional synchronizing cable arranged in a "figure eight" around and connected to reels to constrain rotation of the eccentric elements to occur in synchronism with each other. By synchronizing the rotation of the eccentric rotary elements, the bending of the limbs is also equalized.

The addition of this synchronizing mechanism however increases the complexity and weight of the archery bow. The synchronizing mechanism requires a significant space in the handle section of the archery bow and adds weight. It is highly desirable that the complexity and weight of the bow be minimized for sporting use.

Accordingly, it is an object of the present invention to provide a compound archery bow of the type including tip mounted rotary elements to enable a reduced draw force at maximum draw, but which does not require the presence of load cables adjacent to the bowstring in the nocking region.

It is another object of the present invention to provide an archery bow in which there is provided a substantial longitudinal loading of the bow member limbs which does not result in unequal bending of the limbs and does not necessitate the use of a separate synchronizing mechanism.

It is yet another object of the present invention to provide a variable draw force archery bow having a variable draw force rotary elements of minimum weight and complexity.

SUMMARY OF THE INVENTION

These and other objects of the present invention, which will become apparent upon a reading of the following specification and claims, are achieved by an archery bow construction in which a three-element rotary device is rotatably mounted at each tip of the bow member limbs. All of the elements of each device are constrained to rotate together about a common axis.

The first element is connected to the ends of the bowstring such as to produce rotation thereof upon drawing of the bowstring. The configuration of the first rotary element provides an increasing leverage as the draw progresses such as to produce a reduced draw force at maximum draw of the bowstring.

A pair of load cables are provided which are guided along the limbs and through the handle section, extending from each of the limb tips to the opposite tip. Each load cable is connected at either end to one of the second or third rotary elements so as to exert torques on each rotary device. The configuration of the second and third rotary elements and the point of connection of the load cables produces unequal effective leverage of the forces exerted by the load cables in exerting torque on the rotary devices.

The unequal effective leverage of the second and third elements produces a force acting on each of the limbs tending to deflect the limbs in a longitudinal direction. At the same time, the connection of the load cables to each of the second and third elements produces a coordinated, symmetrical bending of the limbs.

Drawing motion of the bowstring thus produces rotation of the three-element devices which in turn produces a longitudinal bending of the limb tips of the bow member limbs, as well as the transverse bending produced by the bowstring acting directly.

The second and third elements are also configured to provide a decreasing leverage effect as the rotary devices are rotated to accentuate the reduction in draw force produced as the bowstring is moved to maximum draw position.

The three-element rotary device may consist of different configurations, such as an assemblage of crank arms fixed to rotate together and connected to the bowstring and load cables, respectively, each having different effective lever arms to produce the result described.

An eccentrically mounted multi-diameter reel may also be used, each diameter receiving respectively the bowstring and each of the load cables to achieve substantially the same result.

DESCRIPTION OF THE DRAWINGS

FIG. 5 is a diagrammatic representation of the three-element rotary device and associated bow structure shown in FIGS. 1–4, with the bowstring in the relaxed position.

FIG. 6 is a diagrammatic view as shown in FIG. 5, with the bowstring in the full draw position.

FIG. 7 is a diagrammatic representation of another embodiment of the three-element rotary device and associated bow limb structure.

FIG. 8 is an enlarged fragmentary view of the three-element rotary device shown in the bow of FIG. 7.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
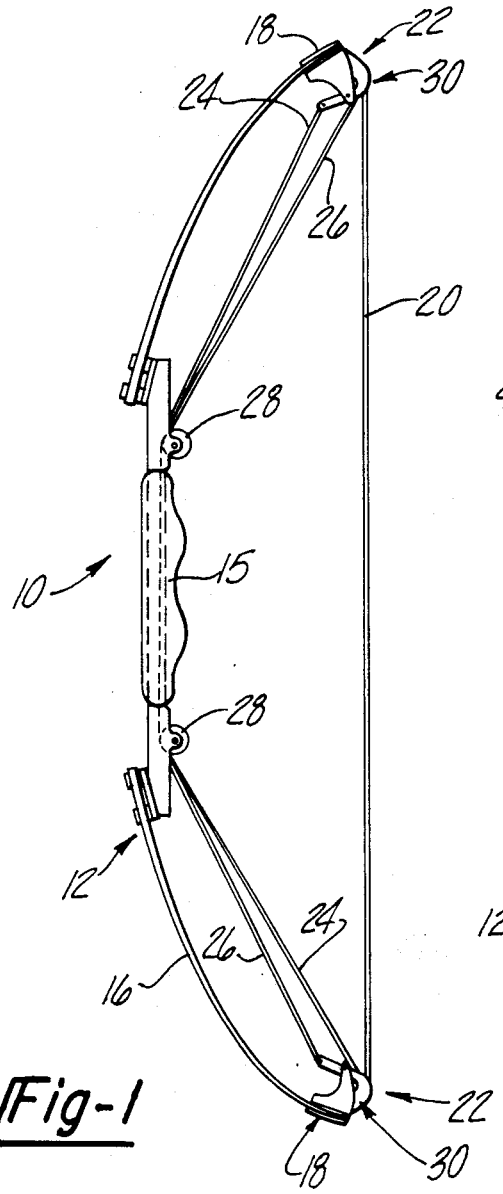
FIG. 1 is a side view of an archery bow according to the present invention.

Referring to the drawings and particularly FIG. 1, the archery bow 10 according to the present invention includes an elongated bow member 12 having a relatively rigid central section 14, to which is normally mounted a grip or handle 15 shown in phantom.

The bow member 12 also includes a pair of elongate curved limbs 16 fixed at either end of the central section 14 which are relatively resilient to bending forces. Each of the limbs 16 terminates in a tip generally indicated at 18 which are substantially aligned on one side of the central section 14, in the fashion of a conventional archery bow.

A bowstring 20 extends between the limb tips 18 and is adapted to be drawn with an arrow nocked thereto to a maximum draw position to cause bending of the limbs 16 generating stored energy which is released to accelerate the nocked arrow (not shown) upon shooting, in the general manner well known in the art.

According to the concept of the present invention, triple-element rotary devices 22 are mounted for rotation about an axis transverse to the plane formed by the bow member 12 and bowstring 20 secured at each of the limb tips 18.

Each of the triple-element rotary devices 22 cause a longitudinal bending force to be exerted on a respective one of the limbs 16 by drawing of the bowstring 20. The bending forces are exerted by first and second load cables 24 and 26 which extend between the triple-element rotary devices 22 in a generally parallel direction with the limbs 16, and with the central section 14 guided by means of a pair of pulleys 28 mounted to the handle section 14.

As noted, the forces generated by the load cables 24 and 26 are in directions tending to produce longitudinal bending of the limbs 16. Generally transverse forces are also exerted directly by the tension in the bowstring 20 to also create a transverse or cantilever beam bending of each of the limbs 16. These forces combine to act on the limbs 16 to produce a combined transverse and longitudinal bending of the limbs 16 upon drawing of the bowstring 20.

Each of the triple-element rotary devices 22 are operatively associated with the bowstring 20 and the load cables 24 and 26 such that as the bowstring 20 is drawn, the triple-element rotary devices 22 rotate about their respective axes of rotation, and thereby act on the load cables 24 and 26 in such a way as to produce an effective shortening of the effective lengths of the load cables 24 and 26, to draw the triple-element rotary devices 22 towards the guide pulleys 28 and thereby bend the limbs 16 longitudinally to generate stored energy for release into the arrow upon shooting. The effective length shortening action and consequent limb bending is coordinated by the concept of the present invention such that the degree of bending of the limbs 16 as a result of the action of the load cables 24 and 26 is insured to be equal in either limbs 16.

The transverse bending of the limbs 16 by the bowstring 20 acting directly is, of course, cross leverage coordinated as described above to produce an overall balancing of the bending of limbs 16.

The triple-element rotary devices 22, the bowstring 20 and load cables 24 and 26 also act as a variable leverage system in which the degree of limb bending produced by a given force exerted by the archer in drawing the bowstring 20 increases greatly as the draw progresses to produce the "compound" action in which the drawing force declines drastically at maximum draw of the bowstring 20 to produce the advantages of the prior art compound bows. This is achieved by the present invention in a distinctly superior manner, as will be described hereinafter in further detail.

Figure 4:
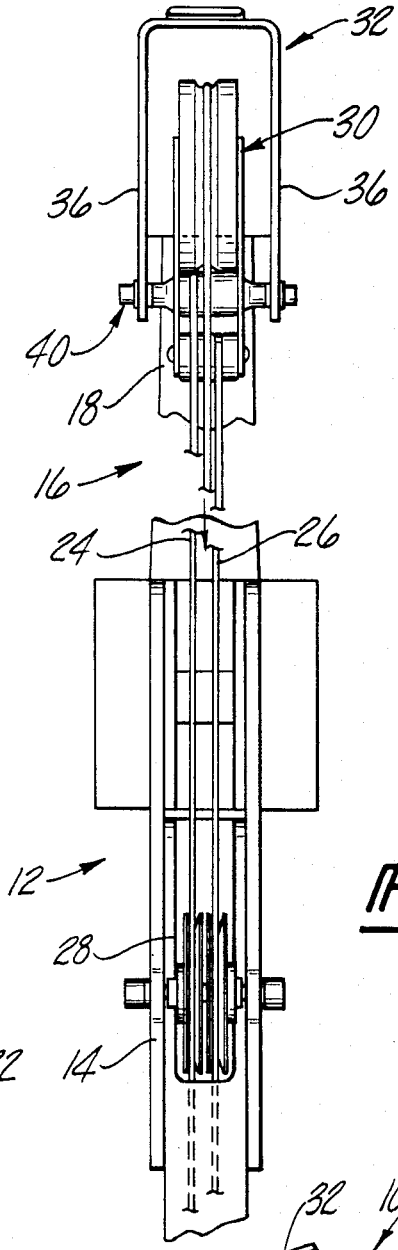
FIG. 4 is a fragmentary rear view of the archery bow central handle section of FIG. 1.
Figure 2:
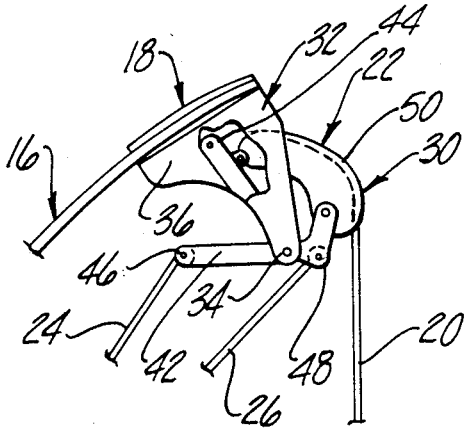
FIG. 2 is a fragmentary enlarged view of the tip portion of the archery bow shown in FIG. 1 showing the details of the three-element rotary device mounted thereto.
Figure 3:
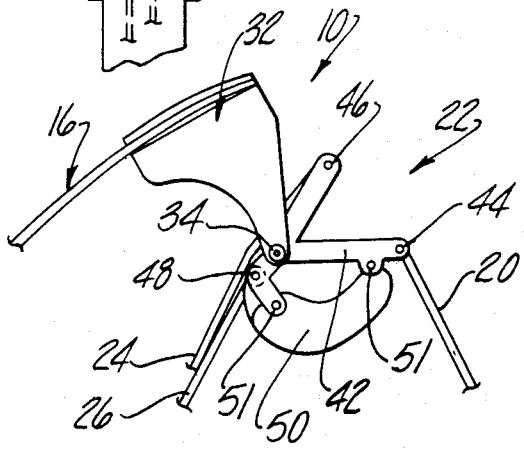
FIG. 3 is a fragmentary view of the tip section of the archery bow shown in FIG. 1 depicting the position of the three-element rotary device with the bowstring in the full draw position.

Referring to FIGS. 2–4, the details of the relationship of the triple-element rotary devices 22, bowstring 20, load cables 24 and 26 and bow member 12 to produce the above-described results can be understood.

In the embodiment shown in FIG. 1, the triple-element rotary devices 22 consist of a bell crank assemblage 30, with driving connections to each end of the bowstring 20 and first and second load cables 24 and 26 defining the respective first, second and third rotary elements constituting the triple-element rotary device 22. The bell crank assemblage 30 is rotatably supported on a bracket 22 mounted on the tip 18 of the limb 16 for rotation about an axis defined by support pin 34 which extends normally to the plane defined by the bow member 12 and the bowstring 20, and is adjacent to the limb tip 18 but spaced offset slightly thereto.

The bracket 32 forms a pair of clevis side plates 36, between which is mounted the bell crank assemblage 30 as by means of the support pin 34, retained by means of suitable retainers 40, such that the bell crank assemblage 30 is free to rotate about the axis defined by the support pin 34.

The bell crank assemblage 30 is composed of a pair of spaced plates 42 which form a clevis for points of connection to the bowstring 20 and the first load cable 24 and second load cable 26 by means of anchor pins 44, 46 and 48, respectively, mounted between plates 42, each receiving a looped end of one of the bowstring 20 and the load cables 24 and 26, respectively, such as to secure the same to the assemblage 30.

The bowstring 20 is also passed around a grooved segment 50 when the bowstring 20 is in its undrawn position shown in FIG. 2. It can be seen that tensioning of the bowstring 20 by drawing generates a force acting on the bell crank assemblages 30 to cause equal and opposite rotation about their axes defined by the support pins 34.

The first load cable 24 and second load cable 26 are connected to the bell crank assemblage 30 at points located so that forces exerted by these cables will be in opposite directions from each other, tending to oppose each other, but with unequal leverage with each other. That is, the effective lever arm about the axis of rotation of assemblage 30 acted on by the first load cable 24 is much larger than that of the second load cable 26, in the position of FIG. 2.

The load cables 24 and 26 are connected oppositely at their other ends to the other triple-element rotary device 22, such that the first load cable 24 is connected at a point on the bell crank assemblage 30 whereat a lesser leverage is achieved, and the second load cable 26 is connected at its other end from that shown in FIG. 2 to the bell crank assemblage 30 at a point whereat a greater leverage is afforded.

The rotation of the bell crank assemblage 30 is in a direction tending to move the longer lever arm points of connection to the load cables away from the handle section 14.

The net effect of this is that as rotation of the bell crank assemblage 30 proceeds, induced by drawing of the bowstring 20, the unequal leverage and opposing relationship of the load cables 24 and 26 tends to draw the tips 18 towards the handle section 14 since the direction of the forces applied by the load cables 24 and 26 is such as to cause longitudinal bending of the limbs 16.

As the rotation of the bell crank assemblage 30 proceeds, an inherent unequal lengthening and shortening of the respective load cables 24 and 26 at either end forces movement or deflection of the limbs 16.

The extent of the bending of the limbs 16 is coordinated due to the driving connection between the respective triple-element rotary devices 22, as a result of the manner in which the load cables 24 and 26 are cross connected. The bending of the limbs 16 by the forces directly applied by the bowstring 20 acting through the support pins 34 is compensated by a cross leverage effect since the bowstring 20 is connected at either end to the oppositely positioned bell crank assemblages 30.

The configuration of the bell crank assemblage 30 and the location of the points of connection of the bowstring 20 and load cables 24 and 26, as well as the geometry of the bell crank assemblage segment 50, produces a variable leverage effect. That is, the leverage exerted by the bowstring 20 increases as the bowstring is drawn to maximum position and rotation of the bell crank assemblage 30 proceeds, as can be seen in FIG. 3. That is, the effective lever arm of the bowstring 20 at the rest position shown in FIG. 2 is much smaller than in the drawn position.

In FIG. 3, the angle of the bowstring 20 and the line of action of the bowstring 20 has shifted with respect to the support pin 34 such that an increased leverage is exerted by the bowstring 20 acting on the bell crank assemblage 30 tending to cause rotation around the support pin 34. This in effect allows a much lower drawing force to maintain the bowstring 20 in its maximum draw position shown.

At the same time, the load cables 24 and 26 also have shifted in relationship to the support pin 34 to be almost in line with each other such that the leverage tending to produce longitudinal deflection of the limbs 16 by the action of the bowstring 20 acting on the bell crank assemblage 30 is also increased so that an enhanced variable leverage effect is achieved by all of these factors.

These variable leverage effects are illustrated in the diagrammatical representation shown in FIGS. 5, 6 and 7. In FIG. 5, the triple-element rotary device 22 is comprised of a bell crank 30 having arms 52, 54 and 56 mounted for rotation on a common axis defined by pin 34 supported on a support bracket 32. The bowstring 20 is connected to the bell crank arm 52 and passes around a deflector arm 59 which allows and controls the line of action of the bowstring 20 and allows it to be passed around the axle pin 34 as indicated.

The bell cranks 30 are caused to be rotated in opposite directions by drawing of the bowstring 20, as shown in FIG. 6. The loading of the load cables 24 and 26 produces longitudinal bending of the limbs 16, and there is achieved a variable leverage of each of the load cables 24 and 26 as the lines of action of these various elements changes with rotation of the bell cranks 30 and the changing angle of the bowstring 20 as it moves to the maximum draw position shown in FIG. 6. The decrease in the load cable leverage during the draw is illustrated by the decrease in the length of the lever arm "a". The increase in the bowstring leverage is illustrated by the increase in the length of the lever arm "b".

The cross connection of the load cables 24 and 26 to the bell cranks 30 insures coordination of the deflection of the bow member limbs 16.

FIGS. 7 and 8 show an alternative form of the triple-element rotary device 22*a*, which comprises an assemblage 30*a*. In this version of the triple-element rotary device 22*a*, a plurality of reels 60, 62 and 64 are mounted to be integral and rotate together therewith about an axis defined by an axle pin 66 about an eccentric axis with respect to the center of the respective reels 60, 62 and 64. The ends of the bowstring 20 are attached to the largest diameter reel 60. The first load cable 24 is attached to the second largest diameter reel 62 at one end and to the smallest diameter reel 64 at its other end.

Similarly, the second load cable 26 is attached to the smallest diameter reel 64 at one end and to the second largest diameter reel 62 at its other end to produce the opposed varying leverage driving relationship of the load cables 24 and 26 as in the above-described embodiment.

Thus, as the bowstring 20 is drawn, rotation of the assemblages 30*a* in equal and opposite directions occurs at either end of the tip. Each of the assemblages 30*a* is supported by means of a support bracket 32*a* to the tip 18 as in the above-described embodiment such as to allow free rotation of assembly 30*a* about axle pin 66.

Accordingly, as the assemblage 30*a* is rotated by drawing of the bowstring 20, a similar effect is produced on the first and second load cables 24 and 26 which produces a coordinated deflection of the limbs 16.

The eccentric location of the axle pin 66 produces a variable leverage with respect to the force able to be exerted by the bowstring 20 as it is drawn to increase the leverage and produce the deflection of the limbs 16, but differs in some respects from the bell cranks of the above-described embodiment.

As will be appreciated by those skilled in the art, there are also differences in mechanical considerations in using these various forms of the triple-element rotary device. That is, when reels are used, the smallest diameter must be quite small so that the largest diameter reel is not required to be excessively large. On the other hand, a reel diameter that is too small may cause excessive bending stress of the load cables as the winding and unwinding of the load cables proceeds.

Also, with the use of bell cranks, simple pivotable pin and clevis attachment is possible for connection of the ends thereto whereas with the reels, cables must be passed into radial openings in order to secure the same thereto and set screws or other attachment means used which tends to shorten cable life.

Finally, with the use of bell cranks, the changes in effective lever arm lengths are related to the angle of rotation of the crank about the axis of rotation; whereas, when reels are used, the changes in effective lever arm result from changes in the tangential diameters at various positions of reels about their axis of rotation.

Therefore, the minimum moment arm length is the smallest effective reel diameter and there will be a pronounced change in leverage due to the geometric effects achieved with rotation of the reels.

Accordingly, it can be appreciated that the above-recited objects of the present invention have been achieved in that relatively simple, lightweight components have been provided to achieve a repositioning of the load cables in a variable leverage bow out of the nocking zone adjacent the bowstring.

Furthermore, this has been achieved without the danger of unequal bending of the limbs of the bow member in longitudinal directions. Longitudinal loading of the limbs has been provided by this arrangement to provide the advantages of such a mode of bending of the limbs but without introducing the equal bending thereof by means of the arrangement whereby the load cables are connected to a triple-element rotary device mounted to each bow tip.

It can be appreciated that the system is capable of taking many forms and variations such as in the configuration of the bow member limbs, bowstring, ahd triple-element rotary device, as exemplified in the embodiments thereof disclosed herein.

It can also be appreciated that it may be desirable to locate the load cables to be offset to the central axis of the bow to enable sighting devices to be utilized in the central-most region of the handle section 14 of the bow member 12. In this arrangement, the guide pulleys 28 and other components thereof may easily be repositioned to an offset location of the load cables as they pass through the central region of the handle section 14 of bow member 12, as will be appreciated by those skilled in this particular art.

I claim:

1. An archery bow comprising:

a bow member comprised of an elongated central handle section and a pair of elongated resilient limbs joined to said handle section at either end, each of said limbs curving towards one side of said handle section and terminating in a limb tip, each of said tips substantially aligned on said one side of said handle section with each other;

a triple-element rotary device comprised of first, second and third rotary elements each mounted on each of said tips, and a driving connecting causing each of said rotary elements to rotate together about a common axis;

a bowstring extending between said tips, and means drivingly connecting said bowstring at either end to a respective first rotary element to apply a torque to each of said first rotary elements upon drawing of said bowstring to cause rotation of said first rotary elements of said rotary device;

the configuration of said first rotary element and said connection of said bowstring thereto producing a variable leverage by said bowstring draw tending to produce rotation thereof which increases with increasing draw to thereby reduce draw resistance;

a first load cable connected at either end to a respective one of said second and third rotary elements to apply a force tending to rotate said second and third elements mounted on opposite tips of said bow limbs;

a second load cable connected at either end to a respective one of said second and third rotary elements tending to rotate said second and third rotary elements mounted on opposite tips of said bow limbs which are not connected to said first load cable tending to apply a force;

said points of connection of said first ad second load cables to said second and third rotary elements mounted on each of said tips of said bow member producing opposing but unequal effective leverage of said first and second load cables in acting on said rotary device;

said point of connection of said bowstring to said first rotary elements being located to tend to produce rotation of said second and third rotary elements so as to draw the load cable connected to the greater leverage of said second and third rotary elements away from said handle section of said bow member;

said points of connection of said first and second cables to said second and third rotary elements eccentric to said common axis and on either side of said common axis with said bowstring undrawn, located such that said first and second cables are moved towards each other as said rotary devices re rotated by said bowstring;

guide means directing both of said first and second load cables to extend in directions substantially aligned with each of said limbs and said handle section of said bow member;

whereby drawing of said bowstring causes rotation of said rotary device to produce forces acting on said limbs by both said first and second load cables in a generally longitudinal direction to said limbs, and transversely by said bowstring and whereby the deflection of each of said limbs is coordinated by said first and second load cables connected to said second and third rotary elements.

2. The archery bow according to claim 1 wherein each of said first, second and third rotary elements comprises a bell crank and each set of associated first, second and third rotary elements are mounted for rotation about a common axis extending transversely to a plane formed by said bow member and said bowstring.

3. The archery bow according to claim 2 wherein each of said bell cranks corresponding to said second and third rotary elements are of different length to produce said unequal leverage, and each extend oppositely from said axis of rotation to produce said opposing leverage.

4. The archery bow according to claim 1 wherein each associated set of said first, second and third rotary elements comprises a set of reels fixed together to rotate together about an axis transverse to a plane formed by said bow member and bowstring, said reels being of differing diameter to produce said differing leverages.

5. The archery bow according to claim 4 wherein each set of said reels are mounted for offcenter rotation to produce said variable leverage of said bowstring and said first and second load cables.

6. The archery bow according to claim 1 wherein said guide means comprises a pair of pulley means each mounted adjacent to said handle section and receiving said first and second load cables thereover.

* * * * *

UNITED STATES PATENT AND TRADEMARK OFFICE

CERTIFICATE OF CORRECTION

PATENT NO. : 4,672,943

DATED : June 16, 1987

INVENTOR(S) : John W. Bozek

It is certified that error appears in the above-identified patent and that said Letters Patent is hereby corrected as shown below:

Column 8, line 10, "ahd" should be --and--.

Column 8, line 34 (Claim 1), "connecting" should be --connection--.

Column 8, line 59 (Claim 1), "ad" should be --and--.

Column 9, line 9 (Claim 1), "re" should be --are--.

Signed and Sealed this

Twentieth Day of October, 1987

*Attest:*

*Attesting Officer*

DONALD J. QUIGG

*Commissioner of Patents and Trademarks*